United States Patent [19]

Morris

[11] Patent Number: 4,605,070

[45] Date of Patent: Aug. 12, 1986

[54] REDUNDANT SAFETY VALVE SYSTEM AND METHOD

[75] Inventor: Arthur J. Morris, Magnolia, Tex.

[73] Assignee: Camco, Incorporated, Houston, Tex.

[21] Appl. No.: 718,628

[22] Filed: Apr. 1, 1985

[51] Int. Cl.[4] ..... E21B 19/16; E21B 34/10; E21B 34/14

[52] U.S. Cl. ..... 166/380; 166/386; 166/322; 166/323; 166/332

[58] Field of Search ..... 166/319, 322, 323, 324, 166/325, 332, 380, 386, 317; 137/515

[56] References Cited

U.S. PATENT DOCUMENTS

| | | | |
|---|---|---|---|
| 3,696,868 | 10/1972 | Taylor, Jr. | 166/323 X |
| 3,799,258 | 3/1974 | Tausch | 166/322 |
| 4,009,753 | 3/1977 | McGill et al. | 166/319 X |
| 4,161,219 | 7/1979 | Pringle | 166/324 |
| 4,291,722 | 9/1981 | Churchman | 166/323 X |
| 4,460,046 | 7/1984 | Pringle | 166/317 |
| 4,534,414 | 8/1985 | Pringle | 166/332 X |

*Primary Examiner*—Stephen J. Novosad
*Assistant Examiner*—John F. Letchford
*Attorney, Agent, or Firm*—Fulbright & Jaworski

[57] ABSTRACT

A first well tubing with a tubing retrievable safety valve having a bore of substantially the same size as the bore of the first well tubing. A second well tubing is connected to the first well tubing above the first well tubing and extends to the well surface and the second well tubing has a bore larger than the bore of the first well tubing. A landing nipple in the second well tubing has substantially the same size bore as the bore of the second well tubing. A wireline retrievable safety valve positioned in the interior of the landing nipple has a bore only slightly smaller than the bore of the first well tubing and thereby does not unduly restrict the flow of fluid through the well tubing.

4 Claims, 4 Drawing Figures

REDUNDANT SAFETY VALVE SYSTEM AND METHOD

BACKGROUND OF THE INVENTION

It is desirable in an oil and/or gas well to provide a well tubing with an unrestricted bore for allowing maximum flow of production fluid therethrough. For this reason, it is conventional to use a tubing retrievable safety valve instead of a wireline retrievable safety valve. That is, a tubing retrievable safety valve is threadably connected into the production tubing string and forms a part thereof and has a bore which is substantially the same size as the bore of the well tubing. On the other hand, a wireline retrievable safety valve is installed on the interior of the well production tubing and consequently has a bore which is considerably smaller than the bore of the well tubing and therefore restricts fluid flow. In the event that the tubing retrievable safety valve fails for some reason it is conventional to lock out the tubing retrievable safety valve and thereafter install a wireline retrievable safety valve in the well tubing as disclosed in U.S. Pat. Nos. 3,696,868 and 3,799,258. However, the newly added wireline retrievable safety valve would undesirably restrict fluid flow through the well tubing.

The present invention is directed to a redundant safety valve system and method of installation which while using both a tubing retrievable safety valve and a wireline retrievable safety valve avoids unduly restricting production through the well tubing.

SUMMARY

The present invention is directed to a redundant safety valve system for a well including a first well tubing having a bore therethrough with a tubing retrievable safety valve threadably connected in the first well tubing. The safety valve has a bore of substantially the same size as the bore of the first well tubing. A second well tubing is connected to the first well tubing above the first well tubing and extends to the well surface. The second well tubing includes a bore which is larger than the bore of the first well tubing. A landing nipple is threadably positioned in the second well tubing and the nipple has substantially the same size bore as the bore of the second well tubing. The landing nipple includes means in its bore for receiving a wireline retrievable safety valve in the bore of the landing nipple.

A still further object of the present invention is the provision of a wireline retrievable safety valve positioned in the interior of the landing nipple in which the wireline retrievable safety valve has a bore only slightly less than the bore of the first well tubing thereby avoiding unduly restricting the well tubing. The bore of the wireline retrievable safety valve is greater than the bore of any wireline retrievable safety valve that could be installed in the first well tubing.

A further object of the present invention is the provision of a method of installing a redundant safety valve system in a well which includes threadably connecting a tubing retrievable safety valve in a first well tubing in which the safety valve has a bore of substantially the same size as the bore of the first well tubing and installing the first well tubing and safety valve in the well. The method includes threadably connecting a landing nipple to a second well tubing in which the landing nipple has a bore of substantially the same size as the bore of the second well tubing and the second well tubing has a bore greater than the bore of the first well tubing. The landing nipple has means in the bore for receiving a wireline retrievable safety valve. The method further includes connecting the second well tubing and landing nipple to and above the first well tubing and installing the second well tubing in the well extending to the well surface.

A still further object of the present invention is installing a wireline retrievable safety valve in the interior of the landing nipple in which the wireline retrievable safety valve has a bore sufficiently great to avoid unduly restricting the flow in the tubing and in any event having a bore greater than the bore of any wireline retrievable safety valve that can be installed in the first well tubing.

Other and further objects, features and advantages will be apparent from the following description of a presently preferred embodiment of the invention, given for the purpose of disclosure and taken in conjunction with the accompanying drawings.

DESCRIPTION OF THE PREFERRED EMBODIMENT

Figure 1A:
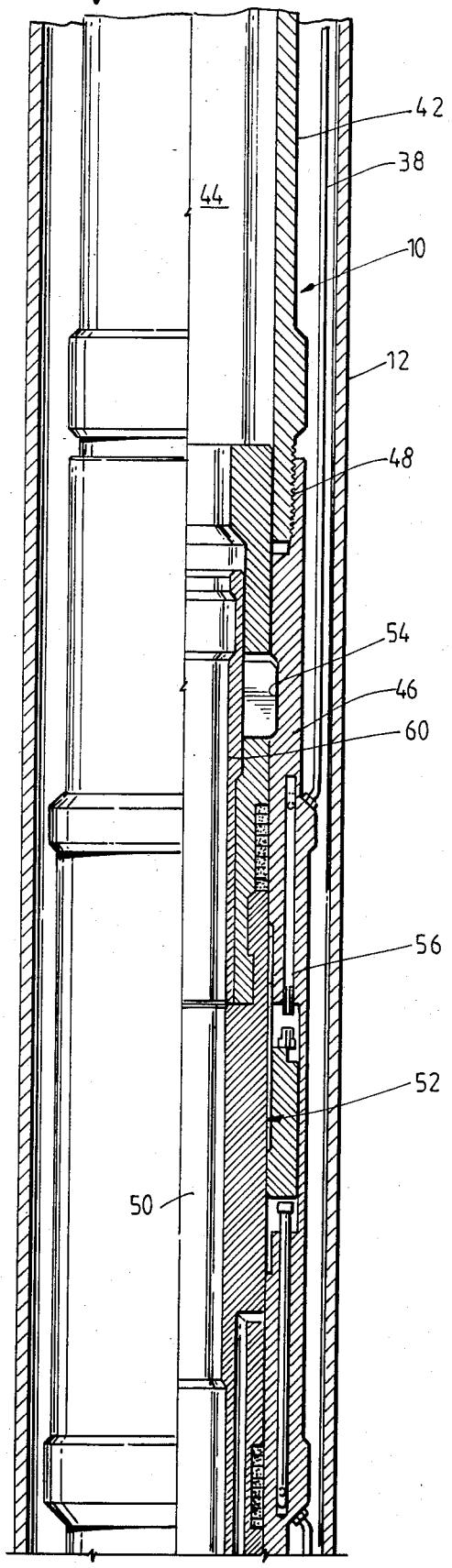
FIGS. 1A, 1B, 1C and 1D are continuations of each other and are elevational views, in quarter section, illustrating the system and method of the present invention.
Figure 1B:
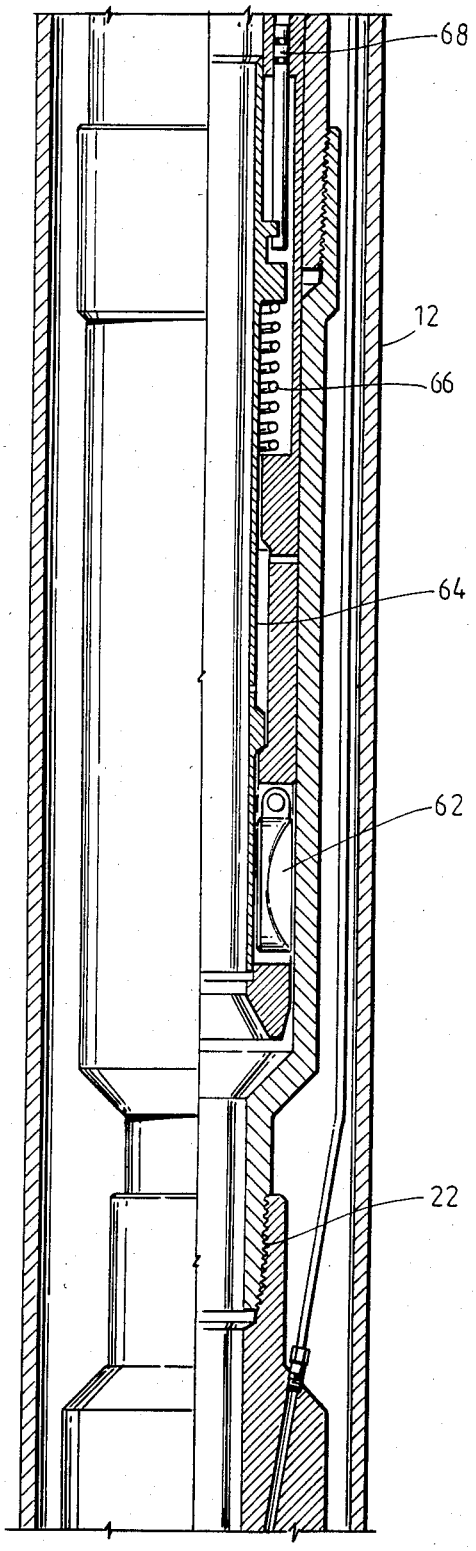
Figure 1C:
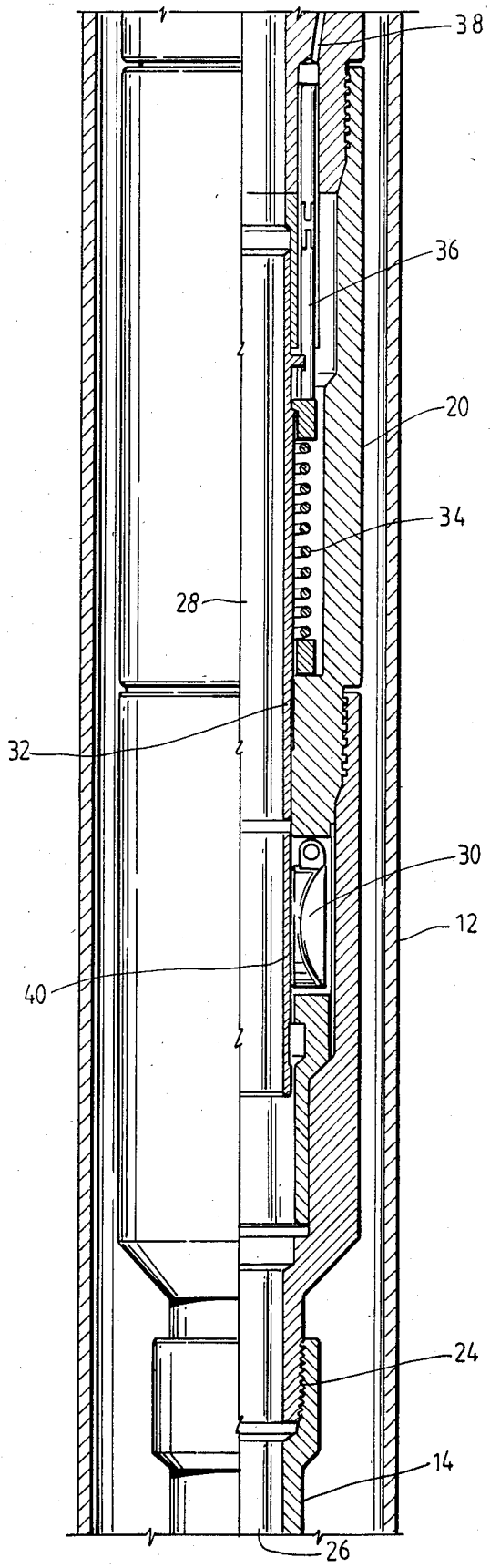
Figure 1D:
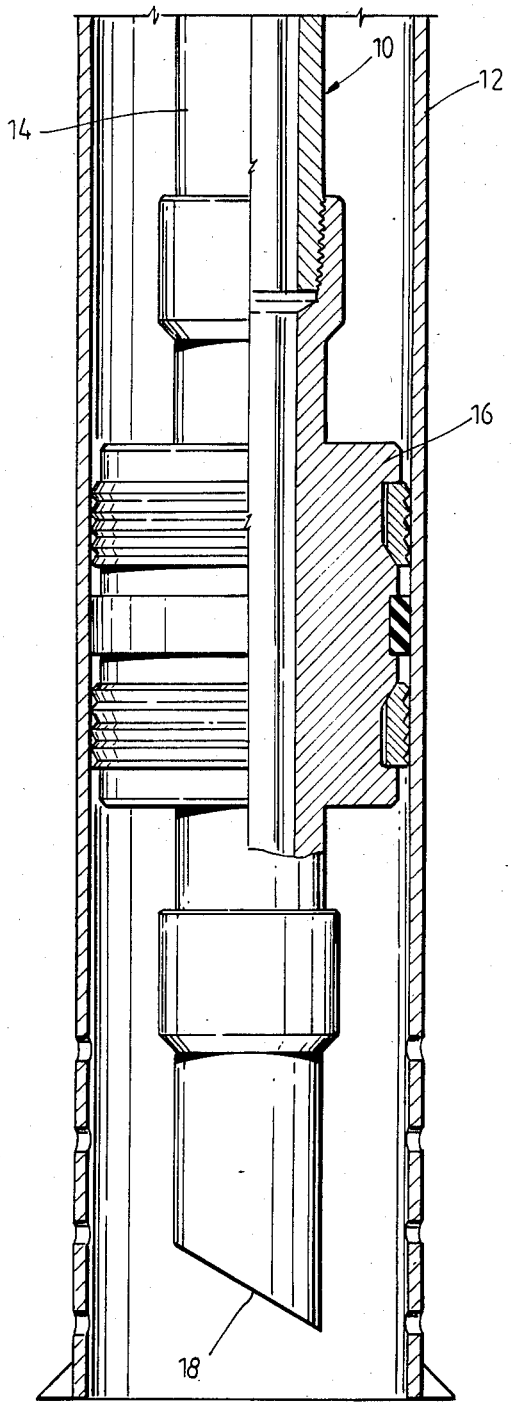

Referring now to the drawings, the redundant safety valve system of the present invention is generally indicated by the reference numeral 10 set in a well casing 12. As is conventional, well tubing 14 (FIG. 1D) extends through the casing 12 and well packer 16 for receiving well production through its lower end 18.

However, the well tubing 14 is required to be protected by a safety valve, preferably a tubing retrievable safety valve 20 which is connected in the well tubing 14 by threads 22 at its upper end and threads 24 at its lower end. The valve 20 is termed a tubing retrievable safety valve as it can only be retrieved when the tubing in which it is placed is retrieved. This is distinguished from a wireline retrievable safety valve which is inserted into and connected to the interior of the well tubing by use of a wireline.

The well tubing 14 has a bore 26 therethrough and the tubing retrievable safety valve 20 has a bore 28 therethrough. The bore 28 is substantially the same size as the bore 26 in the tubing 14. The safety valve 20 may be of any suitable type and is here shown as a Type TRDP sold by Camco, Incorporated and is generally of the type shown in U.S. Pat. No. 4,161,219 with the addition of a lockout. The safety valve 20 generally includes a valve closure member 30 which is controlled by a flow tube 32 which is normally biased upwardly by biasing means 34 and moves downwardly by the action of one or more pistons 36 controlled by hydraulic fluid line 38 leading to the well surface. However, for purposes of illustration the valve is shown in the locked out position by a lockout 40 and is inoperative. When this occurs, an additional safety valve must be provided in the well tubing to protect the well.

The use of a secondary retrievable type safety valve is shown in U.S. Pat. Nos. 3,696,868 and 3,799,258. However, as illustrated in those patents, the use of a secondary wireline retrievable safety valve in the bore of the well tubing restricts fluid flow and limits the production therethrough which is disadvantageous.

The present invention is directed to providing a second well tubing 42 having a bore 44 which is larger than the bore 26 of the first tubing string 14, and the second well tubing 42 is connected to the upper end first tubing string 14 and extends to the well surface. A landing nipple 46 is threadably positioned in the second well tubing 44 by upper threads 48 and lower threads 22 and includes a bore 50 which is substantially the same size bore as the bore 44 of the second well tubing 42. The landing nipple 46 includes means in its bore for receiving a wireline retrievable safety valve generally indicated by the reference numeral 52. The landing nipple 46 includes a recess 54 for receiving conventional lock means for holding the retrievable valve on the interior of the landing nipple 46 and includes a hydraulic control means 56 for switching the hydraulic control fluid in line 38 from the safety valve 20 to the safety valve 52 as more fully described in U.S. patent application Ser. No. 06/565,324 now U.S. Pat. No. 4,534,414, entitled Hydraulic Control Fluid Communication Nipple. Therefore, the landing nipple 46 does not interfere with or restrict the bore 44 of the second well tubing 42.

If needed, in the event of the failure of the tubing retrievable safety valve 20, the valve 20 is locked out and a secondary wireline retrievable safety valve 52 is positioned in the interior of the landing nipple 46 to protect the well. However, because the bore 44 of the second tubing 42 is larger than the bore 26 of the first tubing 14 the safety valve 52 may have a bore 60 which of a larger size than the bore of any wireline retrievable safety valve that could be installed in the bore 26 of the first well tubing 14. Therefore, the valve 20 allows greater fluid flow through the well tubing 14 and 42 without an undue pressure drop.

For example only, the first tubing string may be of conventional $4\frac{1}{2}$ inch well tubing and the second well tubing 42 may be of 7 inch well tubing. In this example, while the bore 28 of the first safety valve 20 has a diameter of 4.900 inches and the bore 60 of the retrievable safety valve 52 has a diameter of 3.625 inches. A wireline retrievable valve which could seat in the bore 26 of the first well tubing 14 would have a bore of $2\frac{1}{8}$ inches. Therefore, the present invention provides a well installation which, while redundantly protecting the well by a safety valve, does not unduly restrict the flow of fluid therethrough.

While the valve 52 may be of any suitable type, such as type WRDP sold by Camco, Incorporated is satisfactory. The mechanism is generally shown in U.S. Pat. No. 4,161,219, and includes a valve closure member 62 controlled by a flow tube 64 which in turn is biased to the closed position by biasing means such as spring 66 and actuated to an open position by one or more pistons 68 in response to fluid flow in the control line 38 leading to the well surface.

The method of the present invention is apparent from the foregoing description of the system. The method is directed to installing a redundant safety valve system in a well comprising threadably connecting a tubing retrievable safety valve in a first well tubing in which the safety valve has a bore of substantially the same size as the bore of the first well tubing and installing the first well tubing and safety valve in the well. The method comprehends threadably connecting a landing nipple to a second well tubing in which the landing nipple has a bore of substantially the same size as the bore of the second well tubing and the second well tubing has a bore greater than the bore of the first well tubing and the landing nipple includes means in the bore for receiving a wireline retrievable safety valve. The method further comprehends connecting the second well tubing and landing nipple to and above the first well tubing and installing the second well tubing in the well extending to the well surface. The method further comprehends installing a wireline retrievable safety valve in the interior of the landing nipple in which the wireline retrievable safety valve has a bore only slightly less than the bore of the first well tubing and has a bore greater than the bore of any wireline retrievable safety valve that could be installed in the first well tubing.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts and steps of the process will readily suggest themselves to those skilled in the art and which are encompassed within the spirit of the invention and the scope of the appended claims.

What is claimed is:

1. The method of installing a redundant safety valve system in a well comprising, threadably connecting a tubing retrievable safety valve in a first well production tubing in a well casing in which the safety valve has a bore of substantially the same size as the bore of the first well tubing, installing the first well tubing and safety valve in the well, threadably connecting a landing nipple to a second well tubing in which the landing nipple has a bore of substantially the same size as the bore of the second well tubing, said second well tubing having a bore greater than the bore of the first well tubing, and said landing nipple having means in the bore of the landing nipple for receiving a wireline retrievable safety valve and including hydraulic control means extending between the landing nipple and the casing for controlling a wireline retrievable safety valve, connecting the second well tubing and landing nipple to and above the first well tubing, and installing the second well tubing in the well casing extending to the well surface.

2. The method of claim 1 including, locking the tubing retrievable safety valve in the open position, and installing a wireline retrievable safety valve in the interior of the landing nipple in which the wireline retrievable safety valve has a bore greater than the bore of any wireline retrievable safety valve installed in the first well tubing.

3. A redundant safety valve system for a well comprising, a first well production tubing have a bore therethrough positioned in a well casing below the well surface, a tubing retrievable safety valve threadably connected in the first well tubing and having a bore of substantially the same size as the bore of the first well tubing, said tubing retrievable safety valve including hydraulic control means extending from said valve to the well surface between the valve and said casing for controlling said valve and including means for locking the valve in the open position, a second well production tubing having a bore larger than the bore of the first well tubing, said second well tubing connected to the first well tubing above the first well tubing and extending to the well surface through the casing, a landing nipple threadably positioned in the second well tubing, said nipple having substantially the same size bore as the bore of the second well tubing, said landing nipple including means in its bore for receiving a wireline retrievable safety valve and including hydraulic control means extending between the landing nipple and the casing for controlling a wireline retrievable safety valve.

4. The system of claim 3 including, a wireline retrievable safety valve positioned in the interior of the landing nipple, said wireline retrievable safety valve having a bore greater than the bore of any wireline retrievable safety valve installed in the first well tubing.

* * * * *